US008220101B2

(12) United States Patent
Chen

(10) Patent No.: US 8,220,101 B2
(45) Date of Patent: Jul. 17, 2012

(54) TELESCOPICALLY ROTATABLE MOP

(75) Inventor: Yung-Hua Chen, Taipei County (TW)

(73) Assignee: Tuo Shen International Corporation Limited, Taoyuan County (TW)

( * ) Notice: Subject to any disclaimer, the term of this patent is extended or adjusted under 35 U.S.C. 154(b) by 392 days.

(21) Appl. No.: 12/648,552

(22) Filed: Dec. 29, 2009

(65) Prior Publication Data

US 2011/0154602 A1 Jun. 30, 2011

(51) Int. Cl.
*A47L 13/20* (2006.01)
*A47L 13/14* (2006.01)

(52) U.S. Cl. ..... 15/119.1; 15/260; 15/229.1

(58) Field of Classification Search ..... 15/119.1, 15/260, 263, 120.1, 120.2, 229.1, 229.2, 15/229.6; 34/58; 248/125.8, 188.5; 135/75, 135/84, 114
See application file for complete search history.

(56) References Cited

U.S. PATENT DOCUMENTS 1,255,804 A * 2/1918 Shipherd ..... 15/120.2
2,087,222 A * 7/1937 Matthews ..... 446/241
4,596,484 A * 6/1986 Nakatani ..... 403/104
4,794,663 A * 1/1989 Vosbikian ..... 15/229.6
D387,527 S * 12/1997 Specht ..... D32/51
5,850,658 A * 12/1998 Specht ..... 15/120.1
5,907,883 A * 6/1999 Thomasson ..... 15/120.2
6,125,494 A * 10/2000 Morad ..... 15/120.2
6,698,698 B1 * 3/2004 Hsieh ..... 248/125.8
2009/0307855 A1 * 12/2009 Kao ..... 15/3

* cited by examiner

*Primary Examiner* — Todd Manahan
*Assistant Examiner* — Tatiana Nobrega
(74) *Attorney, Agent, or Firm* — Rosenberg, Klein & Lee

(57) ABSTRACT

A telescopically rotatable mop, comprising: an internal and external rod fitting to each other in a linearly and telescopically movable state; an engaging element positioned within the opening at the top of the internal rod; a driving element formed in an elongated shape and positioned within the external rod in such a way that the driving element is moved up and down synchronically with the external rod; an actuating element positioned within the engaging element for accommodating the driving element, the engaging element being driven in a single direction when the actuating element is rotated by the driving element. An annular element rotatable clockwise and counterclockwise at 360° is mounted on the top portion of the engaging element. The actuating element received within the engaging element has a smaller length, thereby creating a gap for the lifting and lowering purposes. In this way, a more smooth operation with less effort is ensured when the internal and external rods rotate in a telescopic way.

5 Claims, 10 Drawing Sheets

TELESCOPICALLY ROTATABLE MOP

BACKGROUND OF THE INVENTION

1. Field of the Invention

The invention relates to a telescopically rotatable mop, and more particularly to a structure that ensures a smooth operation in dewatering the mop with one hand only and without use of the feet.

2. Description of the Related Art

After a mop has been used, it is necessary to wring dirty water from mop fabrics (or cotton strips) of the mop before soaking clean water again to facilitate washing a floor, and mopping is obviously a tiresome job. Therefore, related manufacturers have developed various different dewatering devices for the mop, such as a dewatering device disclosed in R.O.C. Pat. No. 347146, wherein a pedal is provided for driving a gear to rotate a dewatering tank at a fast speed, so as to wring cotton strips of the mop placed in the dewatering tank. Although the aforementioned device can improve the inconvenient way of wringing the mop fabrics by hands, yet the operation still requires a user to step on the pedal continuously by one foot, and keep the user's body in balance by another foot. Such arrangement not only involves an inconvenient operation, but also endangers the safety of users when the users fail to stand stably or fall. Therefore, it is necessary to develop a mop with an easy, convenient and safe operation in dewatering.

SUMMARY OF THE INVENTION

An object of the invention is to provide a telescopically rotatable mop that permits a convenient operation with less effort when the internal and external rods rotate in a telescopic way. In this way, the operation failure may be minimized and the service life may be increased.

In order to achieve the above-mentioned objects, the invention includes:

a) an internal rod having a hollow body;

b) an external rod having a hollow body with a bottom portion in a telescopic connection with a top portion of the internal rod;

c) an engaging element positioned within the opening at the top of the internal rod, the engaging element having at the bottom thereof a through hole and at the internal bottom rim a plurality of driven teeth;

d) a driving element formed in an elongated shape and positioned within the external rod in such a way that the driving element is moved up and down synchronically with the external rod;

e) an actuating element positioned within the engaging element with a threaded sleeve at the top thereof for accommodating the driving element, the actuating element having at the bottom thereof a plurality of driving teeth corresponding to the driven teeth of the engaging element for driving the engaging element in a single direction when the actuating element is rotated by the driving element;

f) a fixing cap having a through hole for the insertion of the driving element, the fixing cap being mounted on the opening of the engaging element;

g) a disc body secured to the bottom of the internal rod and having mop yarns;

h) a locking mechanism mounted on the external rod for locking the internal rod and the external rod in place or for unlocking them in a telescopic state, wherein the engaging element is constructed as a cylindrical body with the middle and lower parts secured to the inside of the internal rod, and an annular element rotatable clockwise and counterclockwise at 360° is mounted on the top portion of the engaging element projecting in an exposed manner from the internal rod, and the external diameter D1 of the annular element is greater than the external diameter D2 of the internal rod, but smaller than is almost the same to the internal diameter $\phi$1 of the external rod;

wherein the length L1 of the driving element 50 is smaller than the length L2 of the inside of the engaging element; and wherein the bottom of the fixing cap is extended and secured to the opening of the engaging element in such a way that a gap S is provided between the fixing cap and the top of the actuating element, and the fixing cap includes at the top thereof a projecting flange (whose external diameter is greater than the external diameter D2 of the internal rod, but smaller than the external diameter D1 of the annular element) for positioning the annular element on the periphery of the top portion of the engaging element without affecting the rotation of the annular element within the external rod.

Accordingly, the actuating element is rotated by a linear motion of the driving element when the external rod is moved up-and-down. Moreover, the engaging element is driven in rotation in one direction only, thereby creating a continuous rotation of the internal rod and the disc body in the same direction by the inertia force. As a result, a centrifugal force is produced to throw away the water absorbed in the mop yarns.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
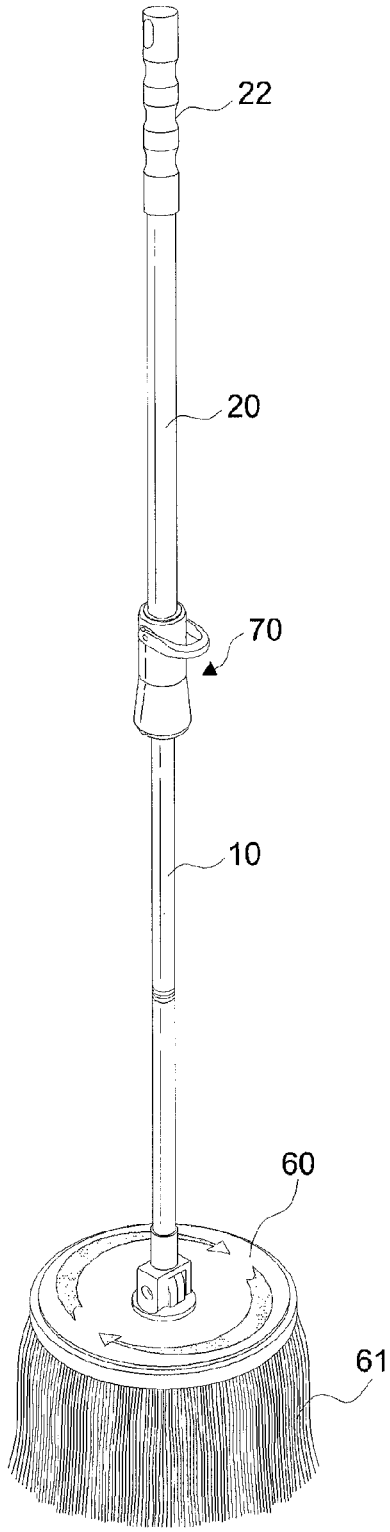
FIG. 1 is a perspective view of the invention.

First of all, referring to FIGS. 1 through 8, a mop in accordance with the invention includes an internal rod 10, an external rod 20, an engaging element 30, a driving element 50, an actuating element 40, a disc body 60, and a locking mechanism 70.

The internal rod 10 is constructed as a hollow circular tube and made by metal or non-metal material. Therefore, it can be an aluminum tube or a plastic tube.

The external rod 20 includes a bottom portion in a telescopic connection with a top portion of the internal rod 10. According to the embodiment, the operator can hold on the external rod 20 to conduct a telescopic motion on the internal rod 10.

Figure 3:
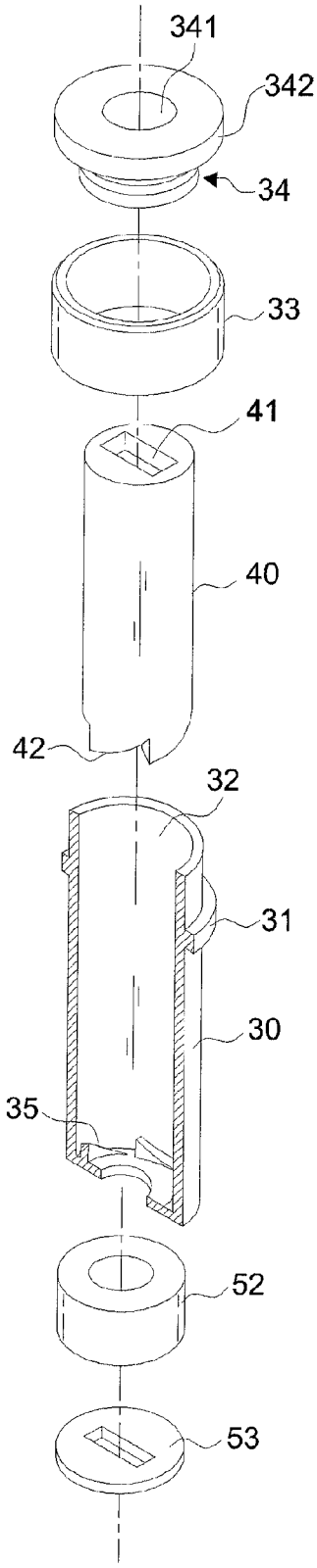
FIG. 3 is an exploded perspective view of the main structure of the invention with the engaging element illustrated in half section.
Figure 4:
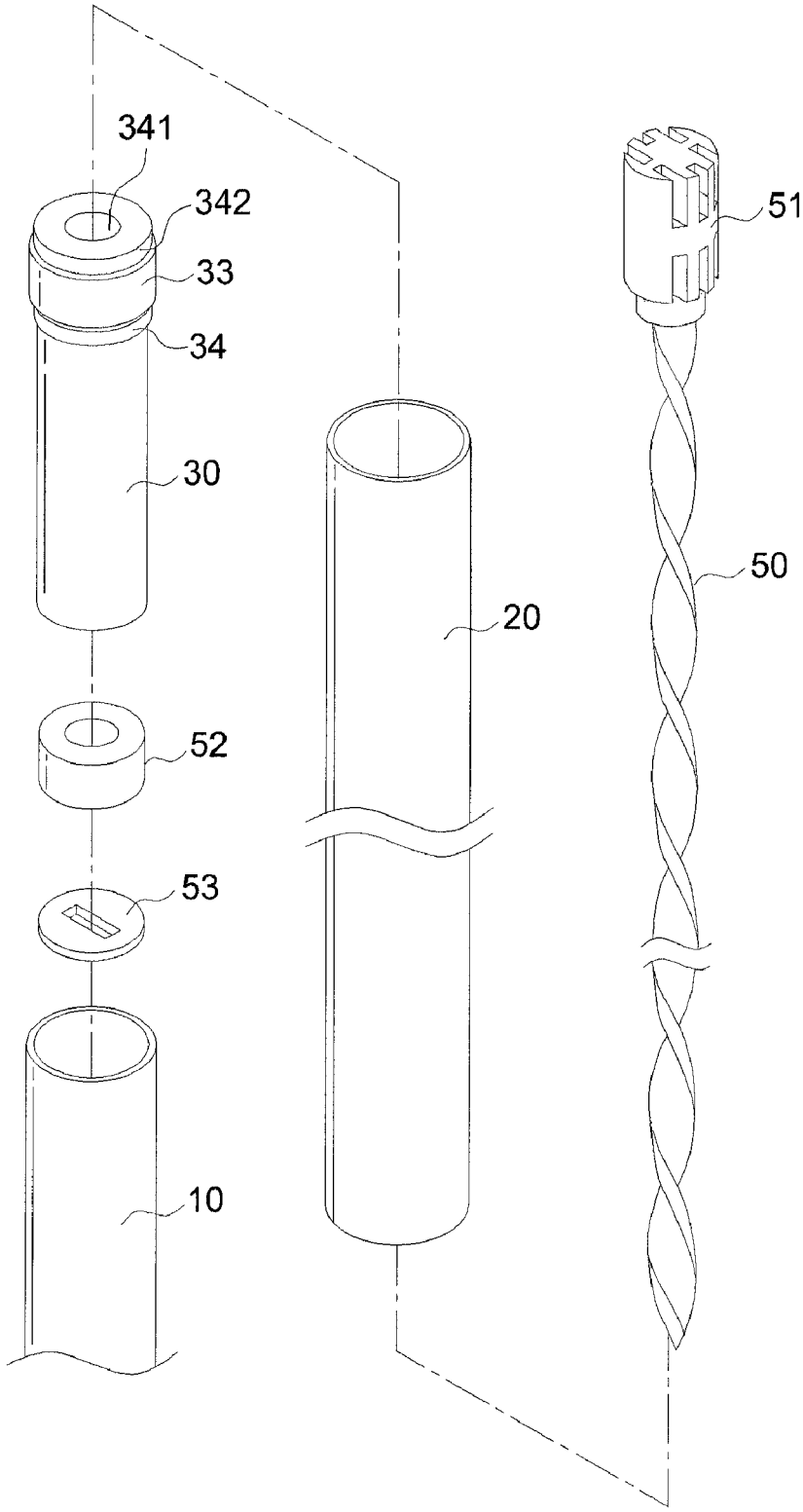
FIG. 4 is an exploded perspective view of the main structure of the invention with the engaging element and the annular element in the connection position

The engaging element 30 is positioned within the opening at the top of the internal rod 10. According to this embodiment, an annular element 33 and a fixing cap 34 are mounted and fixed on the engaging element 30 after the engaging element 30 is placed within the top of the internal rod 10. The upper portion of the engaging element 30 is externally provided with a flange 31. The fixing cap 34 includes a through hole 341 at the top thereof and a projecting flange 342 at the external rim thereof. The bottom of the fixing cap 34 fits into an opening 32 of the engaging element 30 in place. As shown in FIG. 3, the bottom of the internal rim of the engaging element 30 is provided with driven teeth 35.

The driving element 50 is formed in an elongated shape and positioned within the external rod 20 in such a way that the driving element 50 is moved up and down synchronically with the external rod 20. According this embodiment, the driving element 50 includes a fixing block 51 fastened by a fixing element (not shown) or in a riveting way within the top end of the external rod 20. Moreover, a protection sleeve 22 is mounted on the external rod 20.

Figure 7:
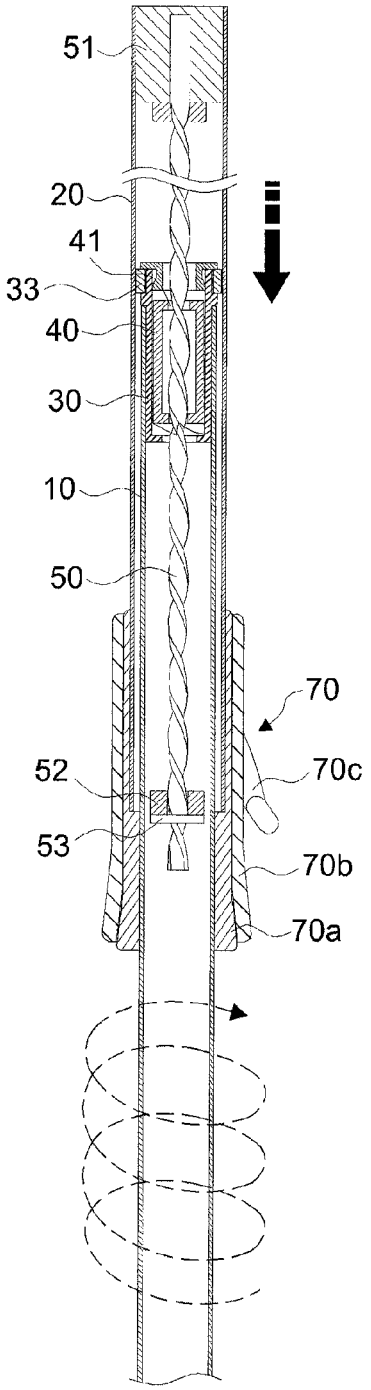
FIG. 7 is a cross-sectional view of the structure in accordance with the invention, showing that the external rod is compressed downward.
Figure 8:
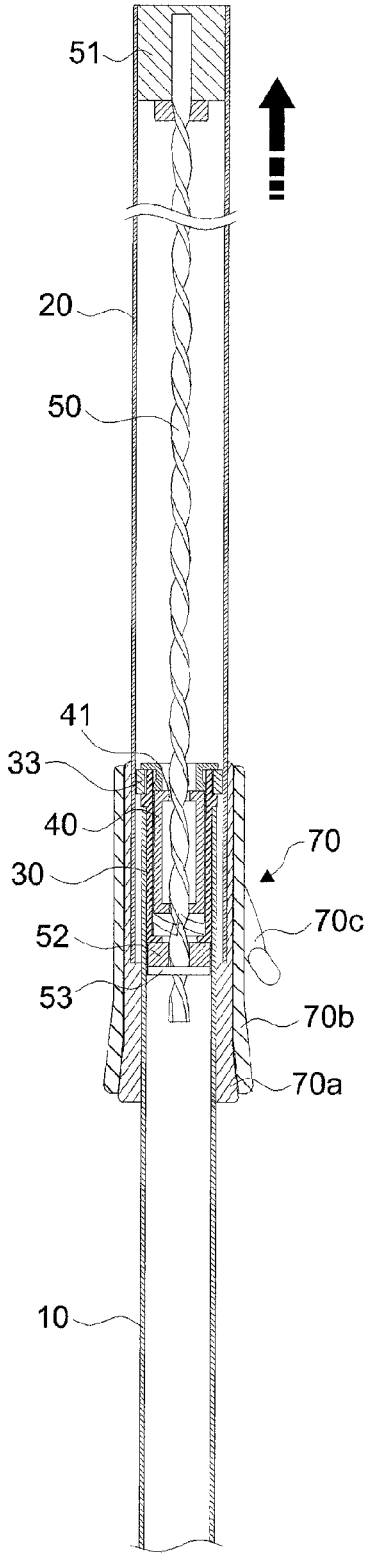
FIG. 8 is a cross-sectional view of the structure in accordance with the invention, showing that the external rod is pulled upward.

The actuating element 40 is positioned within the engaging element 30 for accommodating the driving element 50. The driving element 50 is constructed as a worm or a threaded piece. As a result, the internal wall of the actuating element 40 has to be formed to be a threaded sleeve 41. According to the structure of the worm or the threaded piece, the actuating element 40 is correspondingly provided with a worm thread or an elongated groove such that the driving element 50 may impart a rotary motion to the actuating element 40 by means of the up-and-down linear movement of the external rod 20. According to this embodiment, the driving element 50 is constructed as a threaded piece. As a result, the threaded sleeve 41 at the internal end of the actuating element 40 is constructed as an elongated groove such that the up-and-down movement of the driving element 50 in the threaded sleeve 41 may impart a rotary motion to the actuating element 40 within the engaging element 30. As shown in FIG. 3, the bottom of the actuating element 40 is provided with downward driving teeth 42 in contact with the upward driven teeth 35 of the engaging element 30. Since the engaging teeth are formed in an inclined way, the drive is subject to a rotation in a certain direction. As shown in FIG. 7, the engaging element 30 is subject to a clockwise rotation like the actuating element 40 when the actuating element 40 is driven by the driving element 50. In this way, the actuating element 40 is driven when the driving element 50 is compressed downward. Meanwhile, the engaging element 30 is brought in clockwise rotation. To the contrary, as shown in FIG. 8, when the driving element 50 is pulled upward, the actuating element 40 is brought in a counterclockwise rotation. At that time, the downward driving teeth 42 of the actuating element 40 is driven in an idle non-rotation state relative to the driving teeth 35 of the engaging element 30. In other words, the engaging element 30 remains unmoved such that the driving element 50 can be returned to the original position for a renewed downward compression to drive the engaging element 30 again.

The disc body 60 is secured to the bottom of the internal rod 10 and includes mop yarns 61.

Figure 2:
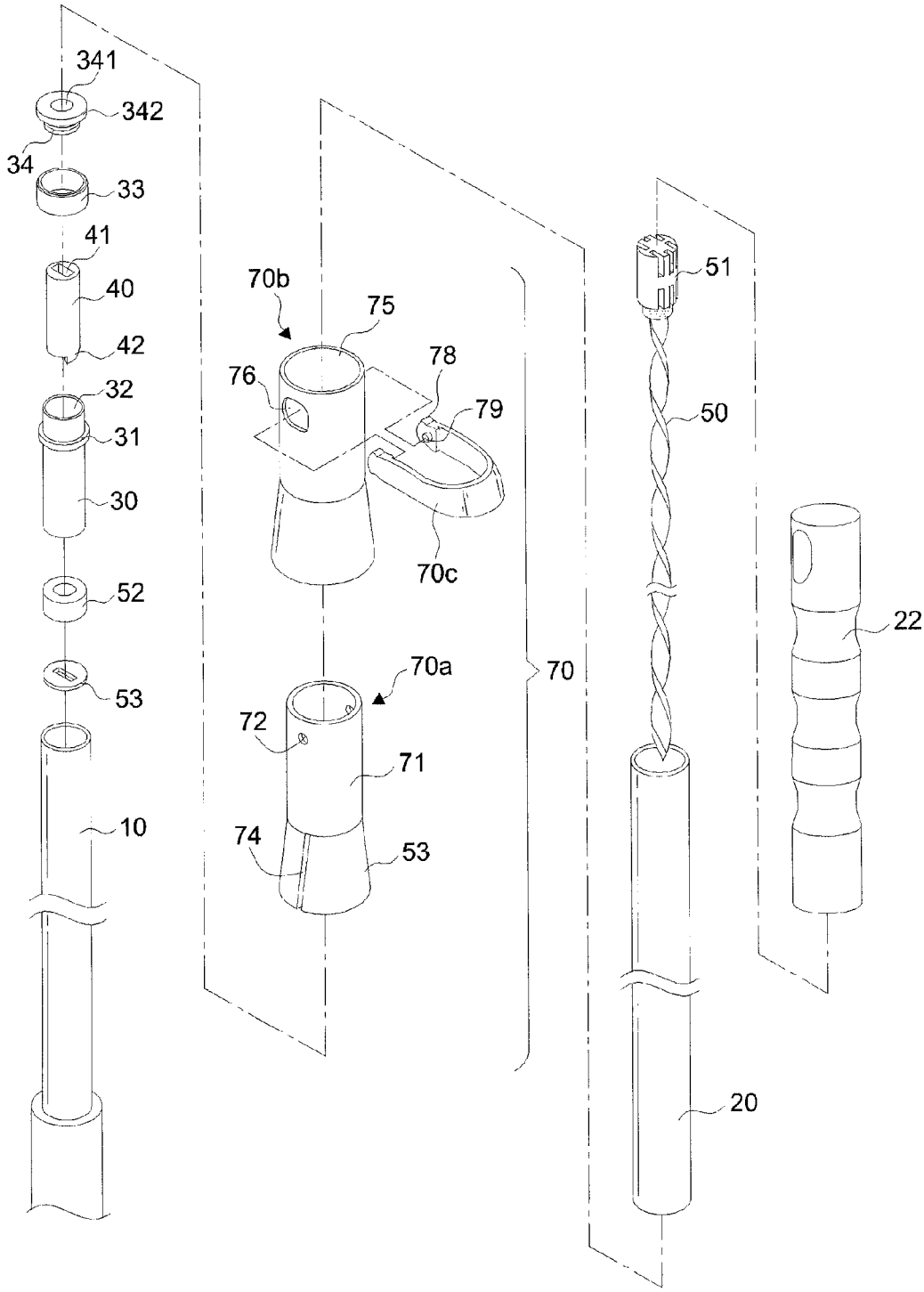
FIG. 2 is an exploded perspective view of the invention.
Figure 9:
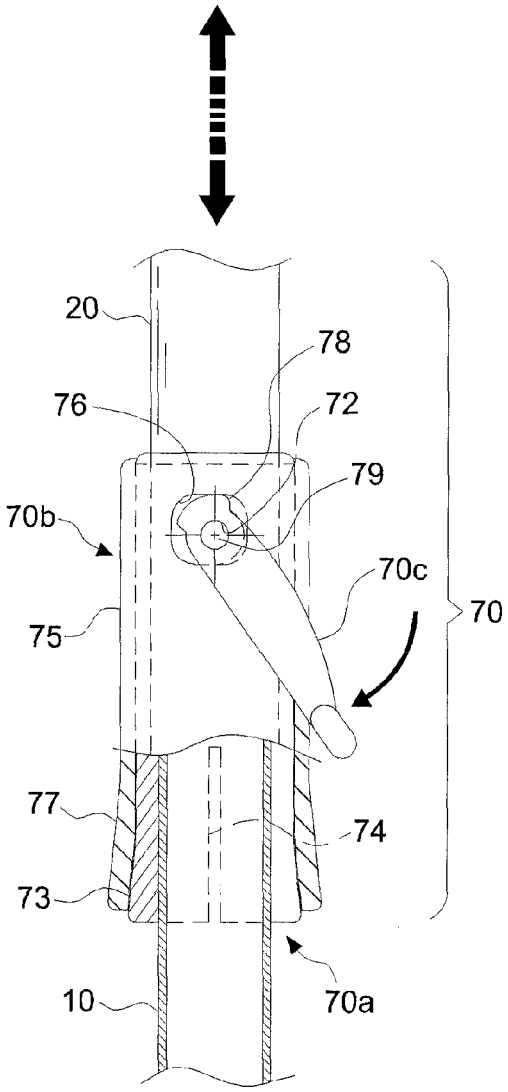
FIG. 9 is a schematic drawing of the locking mechanism of the invention in a loosened position when the external clamping sleeve is lifted.
Figure 10:
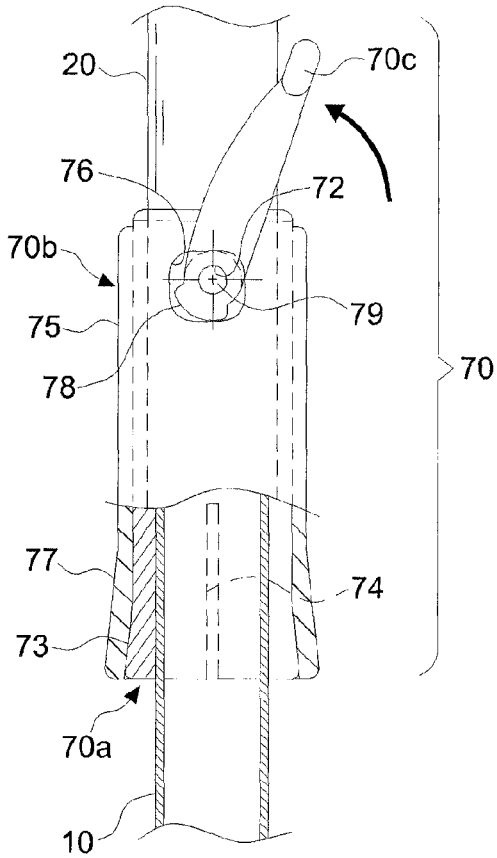
FIG. 10 is a schematic drawing of the locking mechanism of the invention in a tightened position when the external clamping sleeve is lowered.

The locking mechanism 70 is mounted on the external rod 20 for locking the internal rod 10 and the external rod 20 in place or for unlocking them in a telescopic state. As shown in FIGS. 2, 9 and 10, the locking mechanism 70 includes an internal clamping sleeve 70*a*, an external clamping sleeve 70*b*, and a U-shaped lever 70*c*, but should not limited thereto:

The internal clamping sleeve 70*a* includes an internal tube 71 at the top thereof. The bottom of the external rod 20 is introduced into the internal tube 71 and fastened there in place. The fastening effect may be achieved in the clamping, locking, hooking, or screwing way. The fastening technique belongs to the prior art so that no further descriptions thereto are given hereinafter. Both sides of the internal clamping sleeve 70*a* are provided with positioning holes 72. Moreover, the bottom portion of the internal clamping sleeve 70*a* is constructed as a conic body 73 (extending or expanding from the top to the bottom) with an indentation 74. The indentation 74 is extended in axial direction. Preferably, there are at least two indentations 74.

The external clamping sleeve 70*b* is mounted on the periphery of the internal clamping sleeve 70*a*. The upper portion of the external clamping sleeve 70*b* is provided with an external tube 75 corresponding to the internal tube 71. The external tube 75 includes at both sides thereof two mounting holes 76 in alignment with the positioning holes 72 of the internal tube 71. According to the embodiment, the mounting holes 76 are formed as a non-circular and rectangular hole, but should be limited thereto. The mounting holes 76 and the positioning holes 72 are not concentrically positioned such that cams 78 within the mounting holes 76 tend to conduct an eccentric push action. A bell mouth 77 is formed at the lower portion of the external clamping sleeve 70*b* for fitting over the conic body 73.

The U-shaped lever 70*c* includes a swivel protrusion 79 and an eccentric cam 78 at the internal wall of both sides thereof for fitting into the positioning holes 72 of the internal clamping sleeve 70*a* and the mounting holes 76 of the external clamping sleeve 70*b*. Besides, the eccentric cams 78 are positioned within the mounting holes 76. According to this embodiment, the swivel protrusions 79 together with the eccentric cams 38 and the U-shaped locking arm 30*c* are formed by the injection-molding process. However, it should not be restricted thereto. In other words, the swivel protrusion 39 can be replaced by a processed metal post.

Based upon the above-mentioned structure, when the U-shaped lever 70*c* swivels on the swivel protrusion 79, the eccentric cams 78 are offset within the mounting holes 76, thereby moving the external clamping sleeve 70*b* on the periphery of the internal clamping sleeve 70*a* upward or downward. As shown in FIG. 9, the external rim of the internal clamping sleeve 70*a* rises when the U-shaped lever 70*c* is pushed downward. Due to the action of the indentation 74, the bell mouth 77 of the external clamping sleeve 70*b* is brought in a loosened position relative to the conic body 73 of the internal clamping sleeve 70*a*. As a result, the internal rod 10 and the external rod 20 are unlocked and brought in a telescopic state. As shown in FIG. 10, the external clamping sleeve 70*b* is moved downward when the U-shaped lever 70*c* is pulled upward. In this way, the internal clamping sleeve 70*a* is so clamped that the internal and external rods 10, 20 are fixed in place.

As shown in FIG. 7, when the locking mechanism 70 is unlocked in an opened position and the external rod 20 is compressed downward, the driving element 50 is synchronically lowered to pass through the threaded sleeve 41 of the actuating element 40. In this way, the actuating element 40 is rotated clockwise so as to cause a synchronic rotation of the engaging element 30. The engaging element 30 is tightly secured to the internal rod 10. Therefore, the internal rod 10 tends to be rotated in a single direction. When the external rod 20 is pulled upward, as depicted above, the actuating element 40 is in an idle state relative to the engaging element 30 when rotated counterclockwise (see FIG. 8). In this way, the internal rod 10 is subject to a continuous rotation in a clockwise direction due to the inertia force without any intervention from the upward pull of the external rod 20.

Figure 11:
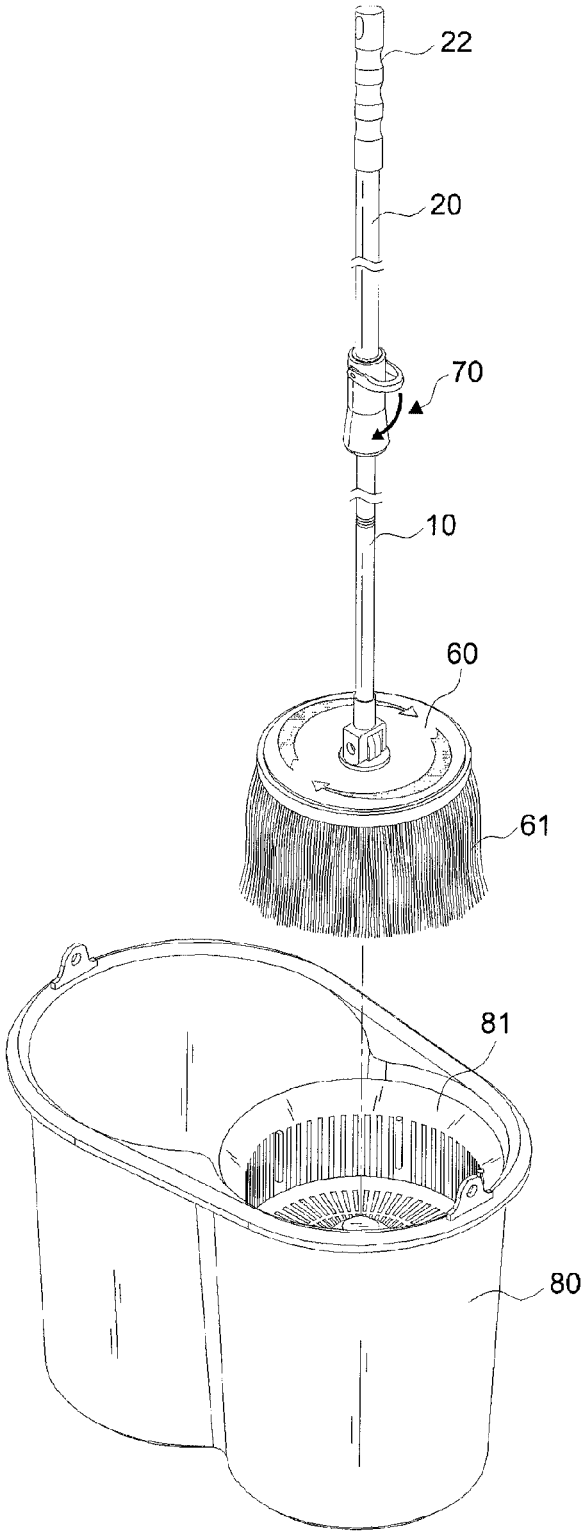
FIG. 11 is an application view I of the invention.
Figure 12:
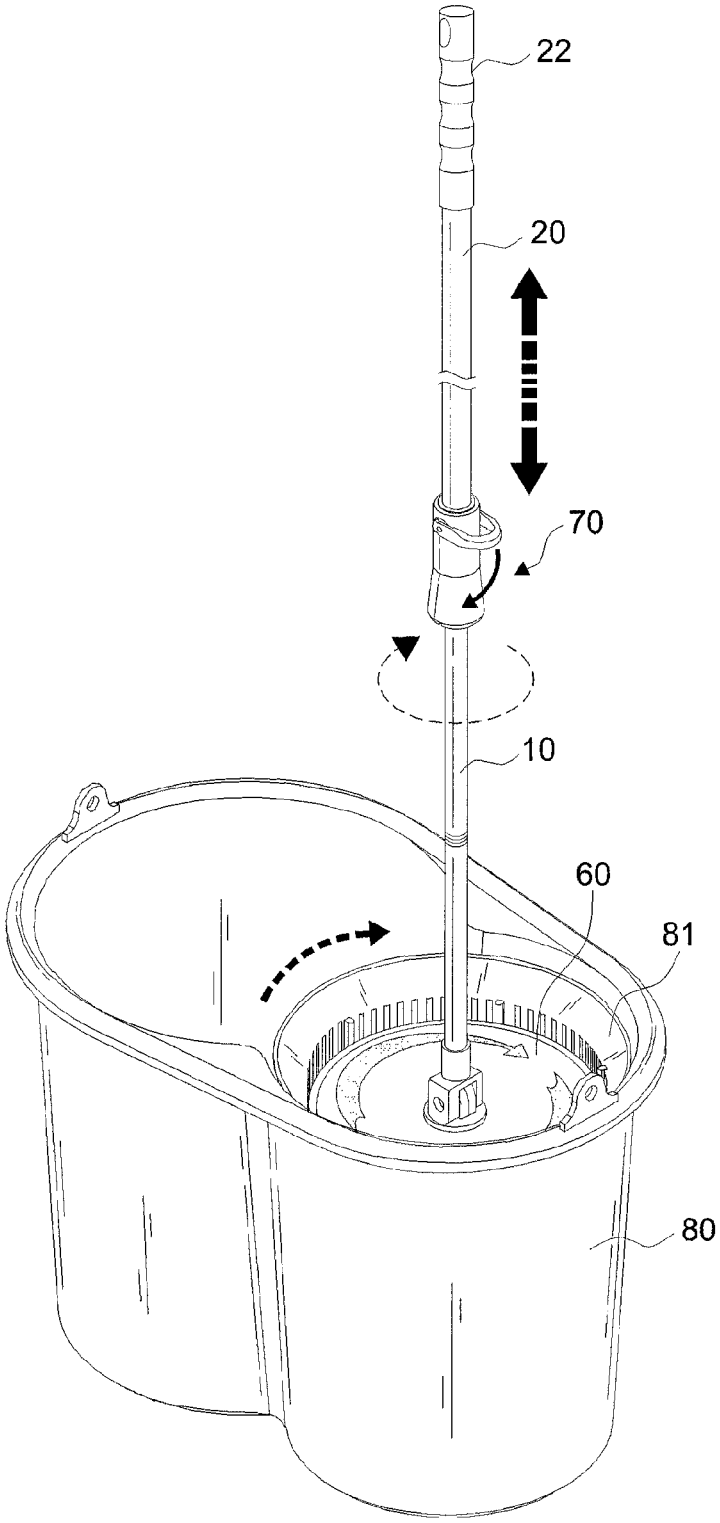
FIG. 12 is an application view II of the invention.

As shown in FIGS. 11 and 12, when the external rod 20 is pushed downward, the internal rod 10 and the disc body 60 are rotated in a single direction, thereby removing the mop yarns 61 (see FIG. 11) attached to the disc body 60 by the centrifugal force outward.

Furthermore, when the external rod 20 is pulled upward, as depicted above, the internal rod 10 won't be acted upon thereby and remains to rotate in the same direction due to the action of the inertia force. In this way, the internal rod 10 and the disc body 60 may be rotated more than 10 times within a dewatering basket 81 of a bucket body 80 by means that the user pushes downward and pulls upward the external rod 20 for a few times. Unlike the conventional bucket body 80 employing an internal drive mechanism to drive its dewatering basket 81 in rotation by a user's foot, the dewatering basket 81 according to this embodiment is rotatable within the bucket body 80. Unlike the conventional way, the dewatering basket 81 in accordance with the invention may be synchronically driven in rotation when the disc body 60 is rotated by the internal rod 10. In this way, the mop yarns 61 of the disc body 60 are subject to the centrifugal force for dewatering. Meanwhile, the water removed may be received within the bucket body 80.

Figure 5:
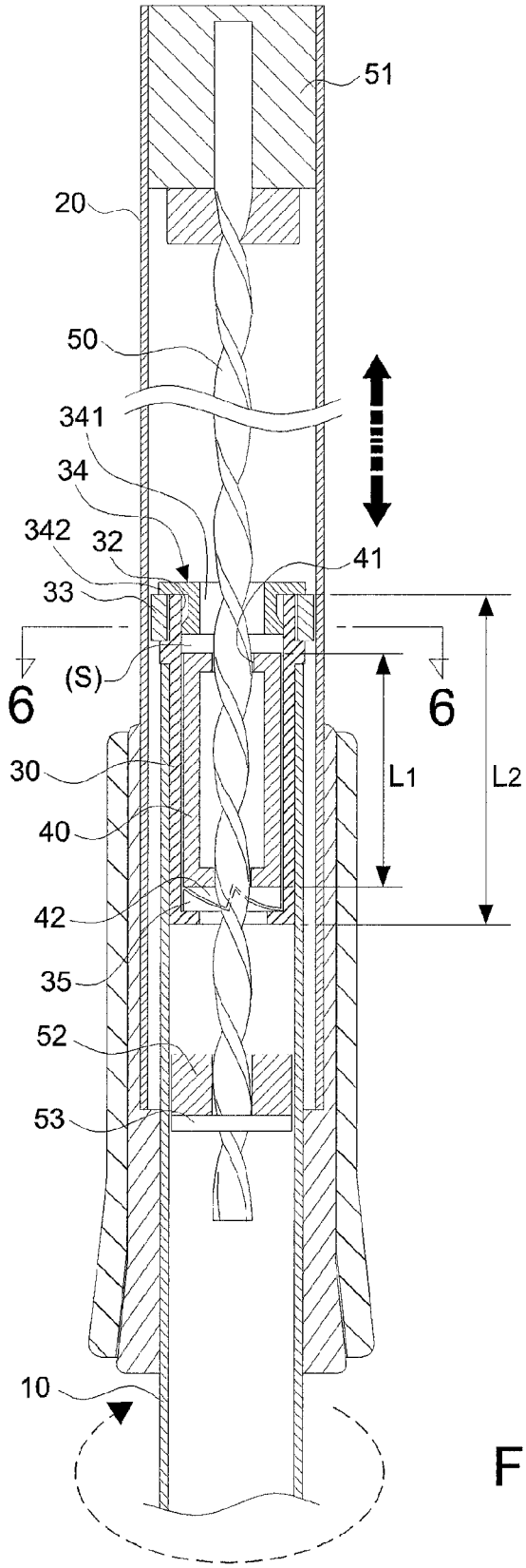
FIG. 5 is a cross-sectional view of the main structure of the invention with the internal and external rods in a position of relative motion.
Figure 6:
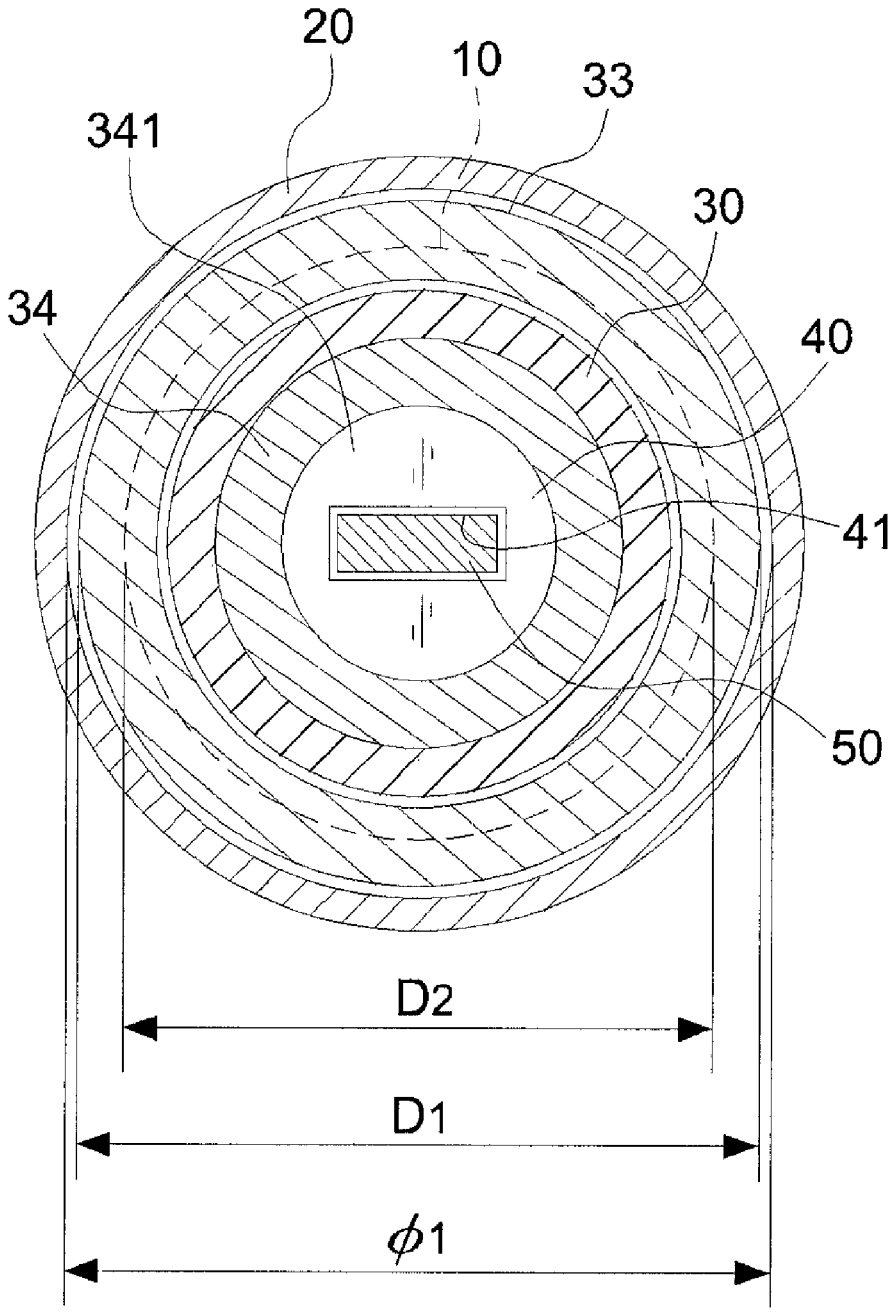
FIG. 6 is a cross-sectional view taken along the line 6-6 in FIG. 5.

However, many tests done for a long time on the above-mentioned structure show that the internal rod 10 is lifted and rotated within the external rod 20 at the time when the external rod 20 is pushed downward and pulled upward (see FIGS. 5 and 6). The reason for that is that a tremendous frictional resistance tends to be created when the internal rod 10 is positioned too closely to the external rod 20 and when the external diameter D2 of the internal rod 10 is almost the same to the internal diameter ϕ1 of the external rod 20. In this way, the telescopic motion of the internal and external rods 10, 20 is not smooth and requires a great effort. If the gap between the internal and external rods 10, 20 is enlarged to eliminate the above-mentioned drawback, they would be placed in an unstable state and moved in a rocking and sloping way. Even, an undesirably great noise can be produced. This requires further improvements.

In order to resolve the above-mentioned problems, the structure in accordance with the invention is provided with following features.

As shown in FIG. 6, the engaging element 30 is constructed as a cylindrical body with the middle and lower parts secured to the inside of the internal rod 10. An annular element 33 rotatable clockwise and counterclockwise at 360° is mounted on the top portion of the engaging element 30 projecting in an exposed manner from the internal rod 10. The external diameter D1 of the annular element 33 is greater than the external diameter D2 of the internal rod 10, but smaller than is almost the same to the internal diameter ϕ1 of the external rod 20. As shown in FIG. 5, the length L1 of the driving element 50 is smaller than the length L2 of the inside of the engaging element 30. In addition, the bottom of the fixing cap 34 is extended and secured to the opening 32 of the engaging element 30 in such a way that a gap S is provided between the fixing cap 34 and the top of the actuating element 40. The fixing cap 34 includes at the top thereof a projecting flange 342 (whose external diameter is greater than the external diameter D2 of the internal rod 10, but smaller than the external diameter D1 of the annular element 33) for positioning the annular element 33 on the periphery of the top portion of the engaging element 30 without affecting the rotation of the annular element 33 within the external rod 20.

Furthermore, the driving element 50 includes at the bottom thereof a position-limiting element 52 and a positioning element 53 for a reliable stop of the driving element 50 in a preset position and for a practical protection of the internal rod 10 and the driving element 50 from being detached from the internal rod 10.

The structure in accordance with the invention is provided to resolve the problems with respect to the telescopic and rotary motions of the internal and external rods 10, 20. Moreover, the structure permits a more smooth operation with less effort. Meanwhile, the noise may be reduced and the service life may be increased.

What is claimed is:

1. A telescopically rotatable mop, comprising: a) an internal rod having a hollow body, a top portion, a bottom portion and an external diameter (D2);

b) an external rod having a hollow body, an internal diameter (ϕ1) and a bottom portion in a telescopic connection with the top portion of the internal rod;

c) an engaging element positioned within an opening at the top of the internal rod, the engaging element having at a bottom thereof a through hole and at an internal bottom rim a plurality of driven teeth;

d) a driving element formed in an elongated shape and positioned within the external rod in such a way that the driving element is moved up and down synchronically with the external rod;

e) an actuating element positioned within the engaging element with a threaded sleeve at a top thereof for accommodating the driving element, the actuating element having at a bottom thereof a plurality of driving teeth corresponding to the driven teeth of the engaging element for driving the engaging element in a single direction when the actuating element is rotated by the driving element;

f) a fixing cap having a top, a bottom, a through hole for the insertion of the driving element, the fixing cap being mounted on the opening of the engaging element;

g) a disc body secured to the bottom portion of the internal rod and having mop yarns;

h) a locking mechanism mounted on the external rod for locking the internal rod and the external rod in place or for unlocking them in a telescopic state, wherein the engaging element is constructed as a cylindrical body with middle and lower parts secured inside of the internal rod, and an annular element having an external diameter (D1) where the annular element is rotatable clockwise and counterclockwise at 360° is mounted on a top portion of the engaging element projecting in an exposed manner from the internal rod, and the external diameter (D1) of the annular element is greater than the external diameter (D2) of the internal rod, but smaller than the internal diameter (ϕ1) of the external rod; wherein the portion of the driving element accommodated by the actuating element has a length (L1) smaller than length (L2) of an inside of the engaging element; and wherein the bottom of the fixing cap is extended and secured to the opening of the engaging element in such a way that a gap (S) is provided between the fixing cap and the top of the actuating element, and the fixing cap includes at the top thereof a projecting flange whose external diameter is greater than the external diameter of the internal rod, but smaller than the external diameter of the annular element) for positioning the annular element on the periphery of the top portion of the engaging element without affecting the rotation of the annular element within the external rod.

2. The mop as recited in claim 1 wherein the driving element has a bottom where said bottom of the driving element includes a position-limiting element and a positioning element at the bottom thereof.

3. The mop as recited in claim 1 wherein the engaging element includes a flange at a periphery of a top portion thereof for securing the engaging element to the inside of the internal rod.

4. The mop as recited in claim 1 wherein the locking mechanism includes:

a) an internal clamping sleeve having an internal tube at a top thereof, the bottom of the external rod being introduced into the internal tube and fastened there in place, both sides of the internal clamping sleeve being provided with positioning holes, a bottom portion of the internal clamping sleeve being constructed as a conic body extending or expanding from the top to the bottom with an indentation;

b) an external clamping sleeve being mounted on a periphery of the internal clamping sleeve, an upper portion of the external clamping sleeve being provided with an external tube corresponding to the internal tube, the external tube having at both sides thereof two mounting holes in alignment with the positioning holes of the internal tube, a bell mouth being formed at a lower portion of the external clamping sleeve for fitting over the conic body; and c) a U-shaped lever having a swivel protrusion and an eccentric cam at an internal wall of both sides thereof for fitting into the positioning holes of the internal clamping sleeve and the mounting holes of the external clamping sleeve, the eccentric cams being positioned within the mounting holes, wherein, when the U-shaped lever swivels on the swivel protrusion, the eccentric cams are offset within the mounting holes, thereby moving the external clamping sleeve on the periphery of the internal clamping sleeve upward or downward, wherein, due to the action of the indentation, the bell mouth of the external clamping sleeve is brought in a tightened or loosened position relative to the conic body of the internal clamping sleeve, thereby locking the internal and external rods in place or unlocking them in a telescopic state.

5. The mop as recited in claim 1 wherein the disc body includes a dewatering basket rotatable within a bucket body, and wherein the dewatering basket tends to be synchronically driven in rotation when the disc body is rotated by the internal rod, whereby the mop yarns of the disc body are subject to the centrifugal force for dewatering, and the water removed may be received within the bucket body.

* * * * *